US008668522B2

(12) United States Patent
Becker et al.

(10) Patent No.: US 8,668,522 B2
(45) Date of Patent: Mar. 11, 2014

(54) ELECTRICAL CONNECTOR

(75) Inventors: Milena Becker, Keltern (DE); Gregor Slatosch, Straubenhardt (DE); Dieter Acker, Straubenhardt (DE); Michael Hirzler, Ettlingen (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 29 days.

(21) Appl. No.: 13/458,308

(22) Filed: Apr. 27, 2012

(65) Prior Publication Data

US 2012/0276776 A1 Nov. 1, 2012

(30) Foreign Application Priority Data

Apr. 28, 2011 (EP) ..... 11164117

(51) Int. Cl.
*H01R 13/648* (2006.01)

(52) U.S. Cl.
USPC ..... 439/607.02

(58) Field of Classification Search
USPC ..... 439/297, 298, 607.02, 607.03
See application file for complete search history.

(56) References Cited

U.S. PATENT DOCUMENTS

| | | | | | |
|---|---|---|---|---|---|
| 2,866,891 | A | * | 12/1958 | Princ | 455/269 |
| 3,569,788 | A | * | 3/1971 | Niblack | 361/727 |
| 4,483,575 | A | * | 11/1984 | Kruger et al. | 439/102 |
| 4,509,258 | A | * | 4/1985 | Locati et al. | 29/876 |
| 4,710,136 | A | * | 12/1987 | Suzuki | 439/297 |
| 4,807,292 | A | * | 2/1989 | Sorscher | 381/86 |
| 4,995,834 | A | | 2/1991 | Hasegawa | 439/620 |
| 5,130,891 | A | * | 7/1992 | Christie | 361/726 |
| 5,266,047 | A | * | 11/1993 | Black et al. | 439/364 |
| 5,285,500 | A | * | 2/1994 | Mantz | 381/86 |
| 5,388,995 | A | * | 2/1995 | Rudy et al. | 439/61 |
| 5,647,768 | A | * | 7/1997 | Messuri et al. | 439/620.09 |
| 5,743,765 | A | * | 4/1998 | Andrews et al. | 439/607.1 |
| 5,761,045 | A | * | 6/1998 | Olson et al. | 361/726 |
| 5,788,532 | A | * | 8/1998 | Takiguchi et al. | 439/374 |
| 5,864,627 | A | * | 1/1999 | Kim | 381/86 |
| 5,873,749 | A | * | 2/1999 | Takiguchi et al. | 439/534 |
| 5,896,473 | A | * | 4/1999 | Kaspari | 385/24 |
| 6,123,565 | A | * | 9/2000 | Bierek et al. | 439/377 |
| 6,123,584 | A | * | 9/2000 | Van Koetsem et al. | 439/607.02 |
| 6,147,596 | A | * | 11/2000 | Tsuchiya et al. | 340/425.5 |
| 6,147,938 | A | * | 11/2000 | Ogawa et al. | 369/12 |

(Continued)

FOREIGN PATENT DOCUMENTS

| | | | |
|---|---|---|---|
| EP | 0 046 967 A1 | 3/1982 | H01R 13/621 |
| EP | 0 460 975 A1 | 12/1991 | H01R 23/68 |
| WO | WO 82/00925 | 3/1982 | H01R 13/621 |

OTHER PUBLICATIONS

Extended European Search Report issued in European Patent Application No. 11164117.1, dated Oct. 14, 2011 (7 pgs.).

*Primary Examiner* — Ross Gushi
(74) *Attorney, Agent, or Firm* — Brooks Kushman P.C.

(57) ABSTRACT

An electrical connector can be provided having a plurality of connector pins, and an electrically conductive connector housing with a bottom wall and a receiving opening for receiving a counter-connector. A plurality of pin receiving openings formed in the bottom wall accommodate a dielectric insert. At least one of the connector pins extends through the dielectric insert and is fastened by the dielectric insert within the respective pin receiving opening. A slide-in module can be provided with such an electrical connector, and a method for producing such an electrical connector may also be provided.

17 Claims, 5 Drawing Sheets

(56) References Cited

U.S. PATENT DOCUMENTS

| | | | | |
|---|---|---|---|---|
| 6,159,048 | A * | 12/2000 | Van Koetsem et al. | 439/607.03 |
| 6,247,944 | B1 * | 6/2001 | Bolognia et al. | 439/157 |
| 6,304,457 | B1 * | 10/2001 | Liu et al. | 361/799 |
| 6,358,075 | B1 * | 3/2002 | Tischner | 439/248 |
| 6,375,507 | B1 * | 4/2002 | Van Koetsem et al. | 439/607.02 |
| 6,469,889 | B1 * | 10/2002 | Gan | 361/679.33 |
| 6,483,428 | B1 * | 11/2002 | Fish et al. | 340/425.5 |
| 6,535,397 | B2 * | 3/2003 | Clark et al. | 361/788 |
| 6,623,280 | B2 * | 9/2003 | Oldenburg et al. | 439/75 |
| 6,735,377 | B1 * | 5/2004 | Hsieh | 386/234 |
| 6,757,164 | B2 * | 6/2004 | Lin | 361/679.35 |
| 6,848,917 | B2 * | 2/2005 | Lang et al. | 439/79 |
| 6,863,543 | B2 * | 3/2005 | Lang et al. | 439/75 |
| 6,890,213 | B2 * | 5/2005 | Ohtsuki | 439/607.35 |
| 6,890,215 | B2 * | 5/2005 | Lang et al. | 439/607.35 |
| 6,916,188 | B2 * | 7/2005 | Lang et al. | 439/101 |
| 6,948,967 | B2 * | 9/2005 | Scherer et al. | 439/377 |
| 7,021,945 | B2 * | 4/2006 | Perugini et al. | 439/74 |
| 7,025,605 | B2 * | 4/2006 | Lang et al. | 439/75 |
| 7,037,138 | B2 * | 5/2006 | Lang et al. | 439/607.1 |
| 7,103,397 | B2 * | 9/2006 | Oh | 455/575.9 |
| 7,401,835 | B2 * | 7/2008 | Gresham et al. | 296/70 |
| 7,450,383 | B1 * | 11/2008 | Li et al. | 361/695 |
| 7,467,955 | B2 * | 12/2008 | Raistrick et al. | 439/75 |
| 7,481,676 | B2 * | 1/2009 | Walter et al. | 439/607.01 |
| 7,553,170 | B2 * | 6/2009 | Minich | 439/83 |
| 7,668,576 | B2 * | 2/2010 | Ellenbogen et al. | 455/575.1 |
| 7,682,171 | B2 * | 3/2010 | Hwang | 439/165 |
| 7,684,201 | B2 * | 3/2010 | Bailey et al. | 361/741 |
| 7,786,613 | B2 * | 8/2010 | Hamaoka et al. | 307/9.1 |
| 7,789,676 | B2 * | 9/2010 | Morgan et al. | 439/79 |
| 7,931,505 | B2 * | 4/2011 | Howard et al. | 439/680 |
| 8,175,279 | B2 * | 5/2012 | Tiwari et al. | 381/1 |
| 8,308,512 | B2 * | 11/2012 | Ritter et al. | 439/607.18 |
| 8,477,512 | B2 * | 7/2013 | Zheng et al. | 361/784 |
| 8,482,927 | B2 * | 7/2013 | Caron et al. | 361/742 |
| 2002/0098727 | A1 * | 7/2002 | McNamara et al. | 439/108 |
| 2002/0180554 | A1 * | 12/2002 | Clark et al. | 333/33 |
| 2003/0013325 | A1 * | 1/2003 | Zaderej et al. | 439/74 |
| 2003/0104724 | A1 * | 6/2003 | Ohtsuki | 439/607 |
| 2003/0114133 | A1 * | 6/2003 | Enners | 455/344 |
| 2003/0128504 | A1 * | 7/2003 | Enners et al. | 361/683 |
| 2004/0018757 | A1 * | 1/2004 | Lang et al. | 439/82 |
| 2004/0038590 | A1 * | 2/2004 | Lang et al. | 439/608 |
| 2004/0087196 | A1 * | 5/2004 | Lang et al. | 439/181 |
| 2004/0161974 | A1 * | 8/2004 | Lang et al. | 439/607 |
| 2006/0039263 | A1 * | 2/2006 | Trotabas | 369/86 |
| 2006/0134959 | A1 * | 6/2006 | Ellenbogen | 439/297 |
| 2006/0134987 | A1 * | 6/2006 | Kohler | 439/608 |
| 2006/0240688 | A1 * | 10/2006 | Perugini et al. | 439/74 |
| 2006/0277555 | A1 * | 12/2006 | Howard et al. | 720/600 |
| 2008/0057758 | A1 * | 3/2008 | Walter et al. | 439/108 |
| 2010/0091997 | A1 * | 4/2010 | Tiwari et al. | 381/1 |
| 2010/0136847 | A1 * | 6/2010 | Hung et al. | 439/701 |
| 2011/0194250 | A1 * | 8/2011 | Perkins et al. | 361/690 |
| 2012/0276776 | A1 * | 11/2012 | Becker et al. | 439/607.01 |
| 2013/0043774 | A1 * | 2/2013 | Karl et al. | 312/223.6 |

* cited by examiner

ELECTRICAL CONNECTOR

BACKGROUND OF THE INVENTION

1. Priority Claim

This application claims the benefit of priority from European Patent Application No. 11 164 117.1 filed Apr. 28, 2011, which is incorporated by reference.

2. Technical Field

The invention relates to an electrical connector, to a slide-in module using such a connector, and to a method for producing such an electrical connector.

3. Related Art

In order to realize external electrical connections of an electronic unit or subunit, electrical connectors are often inserted in an opening of a housing of the electronic unit or subunit. However, such an opening is a weak point with regard to electromagnetic stray radiation, generated either inside or outside the housing that may pass the opening and cause electromagnetic interference (EMI).

SUMMARY

An electrical connector with a number of connector pins and with an electrically conductive connector housing is provided. A bottom wall of the housing may exhibit a number of pin receiving openings which are formed as pin receiving openings of the connector housing. In each one of the pin receiving openings, a dielectric insert can be inserted. Through each one of the inserts, at least one of the connector pins may extend, and can be fastened using the insert within the respective pin receiving opening.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention.

DETAILED DESCRIPTION OF THE PREFERRED EMBODIMENTS

Figure 1:
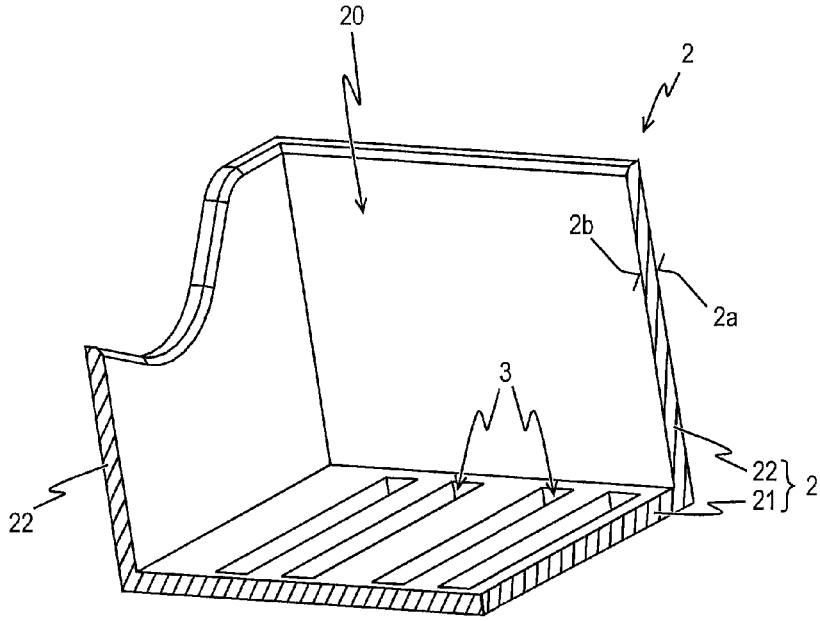
FIG. 1 is a cut-away perspective view of a section of an example connector housing having a number of pin receiving openings.

FIG. 1 is a schematic illustration of a section of an example electrically conductive connector housing 2 having a bottom wall 21, a side wall 22, and a receiving opening 20 for receiving one or more counter connectors (not shown). The connector housing 2 may be made or composed of an electrically conductive metal such as copper, aluminum, zinc or alloys with at least one of these materials. The connector housing 2 may also be made of other materials such as metals. The connector housing 2 may be produced by die-casting, by plastic deformation of a sheet metal, or by insert-casting of plastic within metal connector housing.

In another example, the connector housing 2 may be made of an electrically conductively coated dielectric body such as a plastic body. The coating may be a metallization of the dielectric body. The coating may comprise an outer coating which is deposited on the dielectric body and forms the outer surface 2*a* of the connector housing 2, and/or an inner coating which is deposited on the dielectric body and forms the interior surface 2*b* of the connector housing 2. The electrically conductive coating may cover the whole surface of the dielectric body, only the exterior side of the dielectric body, only the interior side of the dielectric body, or both the interior and the exterior side of the dielectric body. The dielectric body may be made of plastics or of other dielectric material. The dielectric body may be produced by injection molding, blow molding, extrusion molding, or any other form of plastic shaping process. Subsequently, electrically conductive coating may be applied to the dielectric body. The coating may be deposited on the dielectric body using, for example, vapor deposition or sputtering. A material suitable for the coating is, for example, aluminum. Other example materials applicable for the coating are copper, aluminum, zinc, or alloys with at least one of these materials. However, other electrically conductive materials are applicable as well.

The bottom wall 21 is provided with a number of pin receiving openings 3 which serve to allow for the insertion of connector pins. The pin receiving openings 3 are provided in addition to the receiving opening 20. Even though the pin receiving openings 3 shown in FIG. 1 are formed to be generally rectangular and longitudinally extend in the bottom wall 21, pin receiving openings may have any regular or irregular shape.

Figure 2:
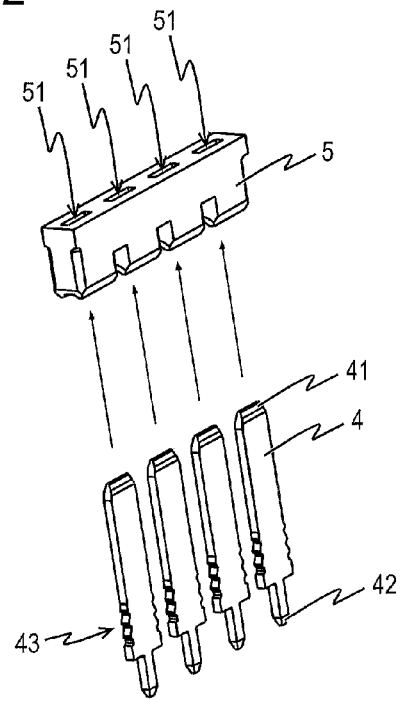
FIG. 2 is a perspective view showing an example dielectric insert and a number of connector pins to be inserted therein.

FIG. 2 shows an example dielectric insert 5 and a number of electrically conductive connector pins 4. The dielectric insert 5 includes clearances 51 that are designed to receive the electrically conductive connector pins 4. In order to guarantee a tight friction fit of the connector pins 4, the clearances 51 can be sized with an aperture sized to be substantially the same as the outside dimension of at least some of the outer surfaces of the connector pins 4. As indicated by arrows, the connector pins 4 may be pressed into the clearances 51 with a first end 41 ahead. The clearances 51 may also be molded around the connector pins 4. The connector pins 4 may also have a ribbing 43 that enables a good grip in the material of the dielectric insert 5. The first end 41 of a connector pin 4 may further be formed as a conical tip which facilitates the insertion of the connector pin 4 in the clearance 51 and in a mating connector as well.

Figure 3:
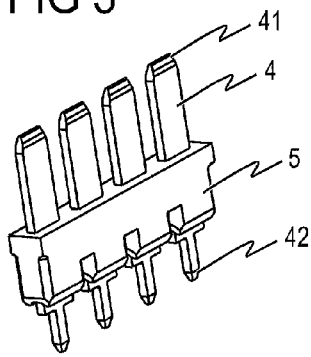
FIG. 3 is a perspective view of the dielectric insert of FIG. 2 studded with the connector pins.

FIG. 3 shows the dielectric insert 5 equipped with connector pins 4. The connector pins 4 completely penetrate the dielectric insert 5. In addition to the first end 41, each of the connector pins 42 has a second end 42 which may also be formed as a conical tip. The first end 41 and the second end 42 may also be formed as other shapes such as pointed, tapered, pyramidal, and dome. The first end 41 and the second end 42 may form antipodal ends of a connector pin 4 and are, after completing the insertion of the connector pin 4 into the insert 5, arranged on antipodal sides of the insert 5. For example, the first end 41 and the second end 42 may be formed on opposite ends of a connector pin 4 and are, after completing the insertion of the connector pin 4 into the insert 5, arranged on opposite ends of the insert 5.

Figure 4:
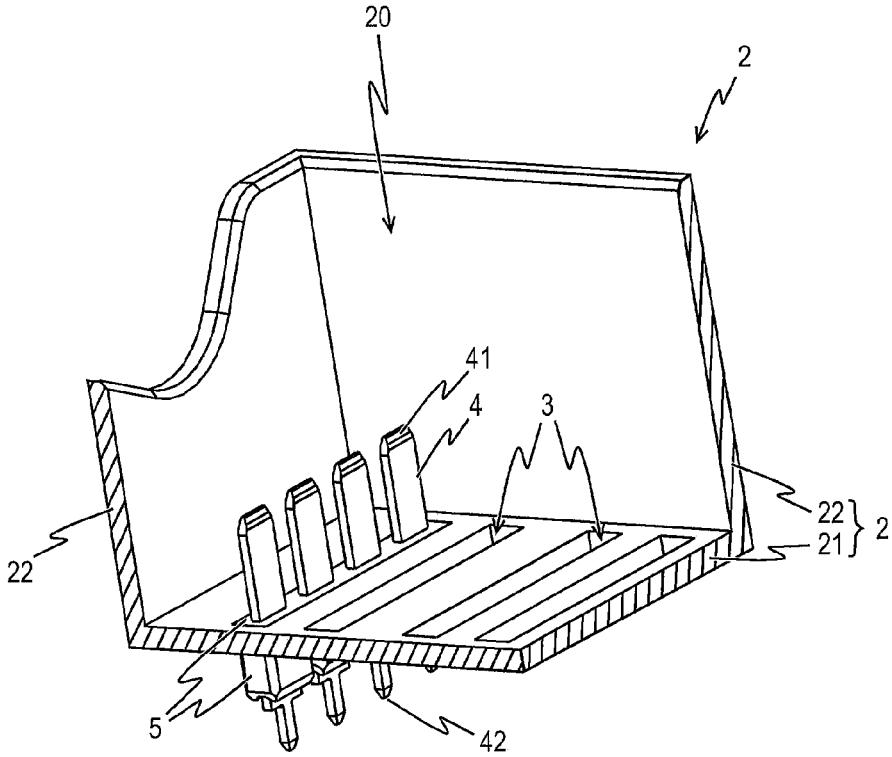
FIG. 4 is the same view as in FIG. 1, however with the studded dielectric insert of FIG. 3 inserted in one of the pin receiving openings of the connector housing.

FIG. 4 illustrates that the insert 5 pre-assembled with the connector pins 4 may be inserted in a corresponding pin receiving opening 3. In case there are two or more pre-assembled inserts 5 to be inserted in corresponding pin receiving openings 3, the insertion of the inserts 5 in the pin receiving openings 3 may be executed at the same time or one after the other. The pin receiving opening 3 can be sized with an aperture sized to be substantially the same as the outside dimension of at least some of the outer surfaces of the insert 5 to provide a tight friction fit. The insert 5 may be pressed into the pin receiving opening 3. The insert 5 may also have a ribbing that enables a good grip with the pin receiving opening 3. The insert 5 may also be tapered or be beveled on one or both ends to facilitate insertion of the insert 5 into the pin receiving opening 3.

Figure 5:
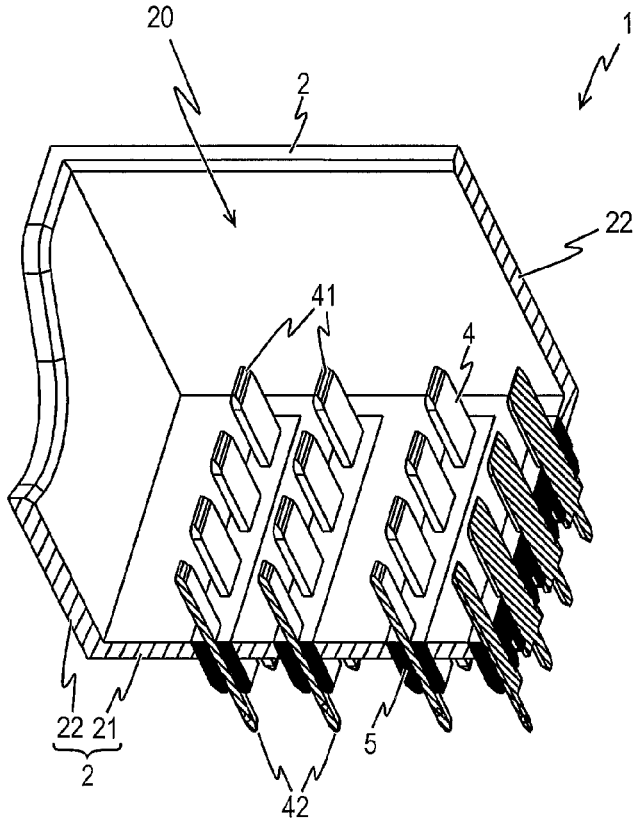
FIG. 5 is the same view as in FIG. 1, however with several studded dielectric inserts as shown in FIG. 3 inserted in the pin receiving openings of the connector housing.

FIG. 5 illustrates a section of an example electrical connector 1 that includes the connector housing 2 with all pin receiving openings 3 equipped with pre-assembled inserts 5. The cut-away view is almost identical to FIG. 4, however, the sectional planes are slightly displaced so as to intersect a row and a column of the connector pins 4 and the corresponding inserts 5, respectively.

As is also illustrated in FIGS. 1, 4 and 5, two, more than two, or all pin receiving openings 3 may have an identical shape and can therefore be equipped with identical pre-assembled inserts 5, such as in the example shown in FIG. 3. However, a connector housing 2 may also have pin receiving openings 3 with different shapes. The pre-assembled inserts 5 may also exhibit different shapes so that they can be adapted to fit in the pin receiving openings 3 having different shapes.

Figure 6:
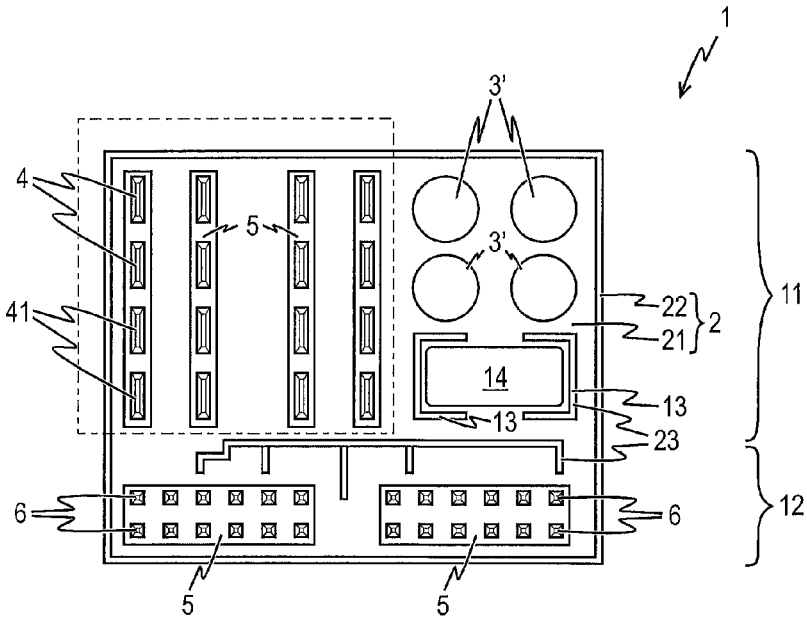
FIG. 6 is a top view of the connector of FIG. 4.

FIG. 6 is a top view of the electrical connector 1 as a whole. The dashed line indicates the section of the connector housing 2 as shown in at least FIGS. 1 and 4. The inserts 5 equipped with the connector pins 4 are arranged in a first area 11 of the connector 1. The connector 2 further includes electrically conductive connector pins 6, which also have first ends 61 and second ends 62 (shown in FIG. 12), and, compared with the connector pins 4, a lower width and a lower ampacity. The connector pins 4 may be used for at least one power supply connection, and the connector pins 6 for the connection of analog and/or digital low power signals. The assembly of the connector pins 6 in the connector housing 2 may take place in the same manner as described with reference to the connector pins 4.

Figure 7:
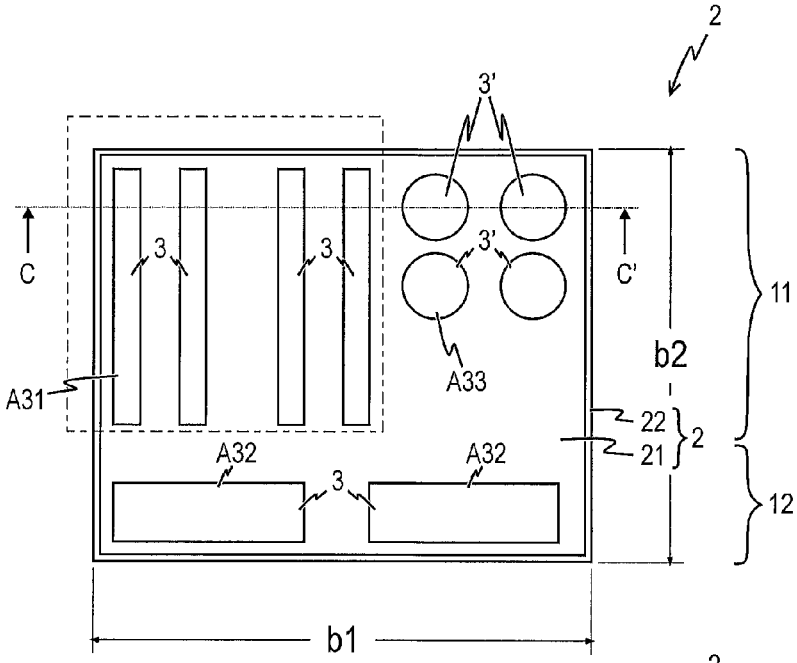
FIG. 7 is a top view of the connector housing of FIG. 1.

In the present example, two dielectric inserts 5 were pre-assembled with twelve connector pins 6 in two rows each and then inserted into corresponding pin receiving openings 3 as can be seen from FIG. 7 which is a top view of the connector housing 2 with all inserts 5 and connector pins 4, 6 being removed. Generally, the number of dielectric inserts 5 and the number of connector pins 6 may vary depending on the respective application.

FIG. 6 also illustrates an electrical connector 1 that may feature further elements like a fuse holder 13 in which for illustration purposes a fuse 14 is inserted. The connector housing 2 may also have one or more further pin receiving openings 3' which may be arranged in the bottom wall 21. The pin receiving openings 3' may be used to accommodate optical connectors or other components.

The connector housing 2 may have one or more separating webs 23 which may be formed integrally with the connector housing 2. For example, the separating webs 23, the bottom wall 21 and the side wall 22 may be made of one piece if the connector housing 2 is produced by a molding technique such as injection molding. Such webs 23 may serve as guidance for a counter connector and/or as polarizing key in order to ensure that a counter connector is inserted into the receiving opening 20 at the right place and with the correct orientation. The webs 23 may also be made or composed of an electrically conductive metal or may be made of an electrically conductively coated dielectric body similar to the connector housing 2. As such, the webs 23 may provide electromagnetic shielding between connector pins such as between the connector pins 4 and the connector pins 6.

Figure 8:
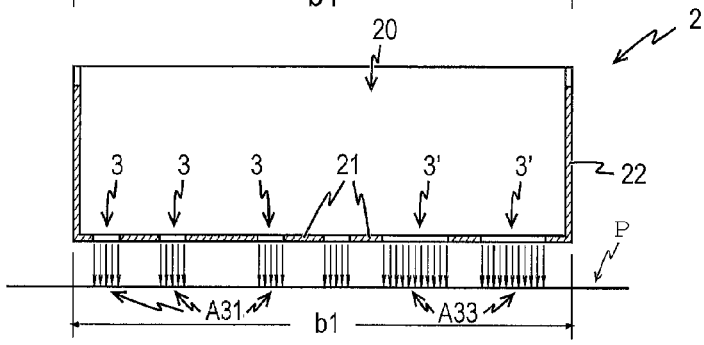
FIG. 8 is a cross-sectional view of the connector housing of FIG. 7 in a sectional plane C-C'.

FIG. 7 illustrates the connector housing 2 where all inserts 5 and other elements are removed in order to illustrate the pin receiving openings 3, 3'. A cross-sectional view in a sectional plane C-C' is provided by FIG. 8. As shown in FIGS. 7 and 8, the relative sizes of the pin receiving openings 3, 3' in the bottom side 21 of the connector housing 2 and, therefore, the total sizes such as the area of the apertures of all the pin receiving openings 3, 3' may be limited. For example, as further discussed below, the total aperture area of the pin receiving openings 3, 3' in the bottom side 21 of the connector housing 2 may less than a certain percentage of the total area of the bottom side 21 such as the total aperture area of the pin receiving openings 3, 3' in the bottom side 21 may be less than about 39% of the total area of the bottom side 21. Furthermore, the electrically conductive material of the bottom wall 21 can act as an electromagnetic shielding and therefore, can help to suppress electromagnetic interference. For example, the electromagnetic shielding can suppress electromagnetic interference from entering an electronic device from the connector housing 2. In order to further improve the shielding effect, the bottom wall 21 may be electrically connected to an electrical ground potential of a device to which the electrical connector 1 is mounted.

As can be seen from, for example, FIGS. 1, 4-5 and 8, the connector housing 2 may be trough-shaped such that the side wall 22 surrounds, at one end, the bottom wall 21. Since the connector housing 2 may be made of a single, electrically conductive piece, the bottom and side walls 21, 22 may be electrically connected to each other so that the side wall 22 also serves as an electromagnetic shielding.

The shielding effect of the bottom wall 21 is higher as the ratio is lower between the sum of the aperture areas of the pin receiving openings 3 and 3' and the floor area of the connector housing 2 to which the bottom wall 21 substantially contributes. For example, the floor area may be the entire bottom wall 21 extending to the side wall 22. In the present example, four pin receiving openings 3 intended for the accommodation of the inserts 5 pre-assembled with the connector pins 4 each have the same aperture area A31. Accordingly, two pin receiving openings 3 intended for the accommodation of the inserts 5 pre-assembled with the connector pins 6 each have the same aperture area A32. Then, each of the four further pin receiving openings 3' has an aperture area A33.

An aperture area A31, A33 of a pin receiving opening 3, 3' is defined as the area of the pin receiving opening's 3, 3' orthogonal projection on a plane P. The expression "orthogonal" refers to the direction of the projection relative to the plane. In FIG. 8, the direction of the projection is indicated by means of arrows.

When calculating an aperture area A31, A32, A33, the result can depend on the orientation of the connector housing 2 relative to the plane P. To calculate the aperture area A31, A32, A33, the connector housing 2 can be oriented such that the connector housing's 2 bottom wall 21 formed to include the pin receiving openings 3, 3' faces towards the plane P, and such that the projection of the sum of the aperture areas A31, A32, A33 on the plane P of all pin receiving openings 3, 3' formed in the bottom wall 21 are at a maximum. For example the bottom wall 21 may be substantially parallel with the plane P. In the present example, the sum A30 of the aperture areas A31, A32, A33 of all the pin receiving openings 3, 3' formed in the bottom wall 21 is:

$$A30=4*A31+2*A32+4*A33.$$

The floor area A2 of the connector housing 2 is defined as the area of the bottom wall's 21 orthogonal projection on the plane P if the connector housing 2 is oriented relative to the plane P, as described above. Hence, the floor area A2 of a connector housing 2 is, in the plane P, the area enclosed by the circumferential line the connector housing 2 has in the projection. For example, the floor area A2 may include the area of the bottom wall 21 as well as the pin receiving openings 3, 3'. In the present example, the floor area A2 is:

$$A2=b1*b2;$$

where b1 is the length and b2 is the width of the connector housing 2, as shown in FIG. 7. In the present example, the calculation of the floor area A2 can be simple as the side wall 22 runs perpendicular to the floor wall 21 and the plane P. However, in other applications, the angle between different sections of the side wall 22 and the plane P may be different from 90°. Generally, a sidewall 22 may also be curved, and/or may have recesses and/or protrusions.

Since the electromagnetic shielding effect may be substantially caused by the electrically conductive bottom wall 21, as mentioned above, the ratio A30/A2 between the sum A30 of all aperture areas A31, A32, A33 in the bottom wall 21 and the floor area A2 of the connector housing 2 may be kept as low as possible. For example, the ratio A30/A2 may be less than or equal to about 0.39.

The shielding effect can also be important for connectors with large floor areas A2. For example, the floor area A2 may be greater than 20 mm×20 mm. In the example explained above, the dielectric inserts 5 were pre-assembled with connector pins 4, 6 and then inserted into pin receiving openings 3 of the connector housing 2.

Figure 9:
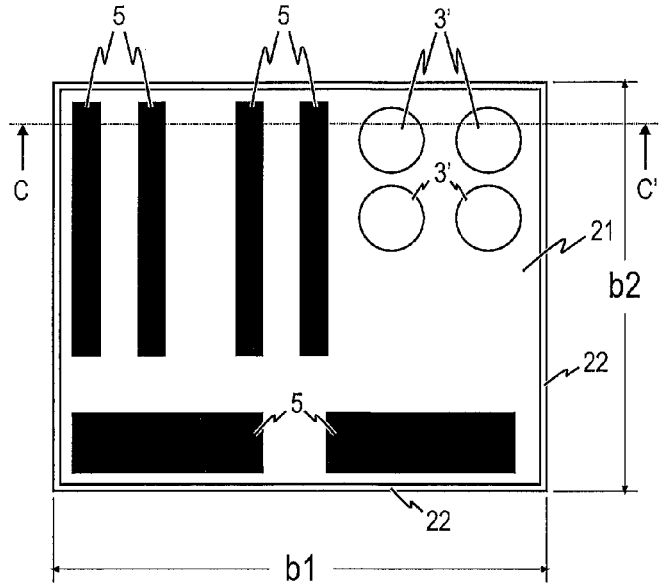
FIG. 9 is the same view as in FIG. 7, however with a number of example dielectric inserts molded in some of the pin receiving openings.
Figure 10:
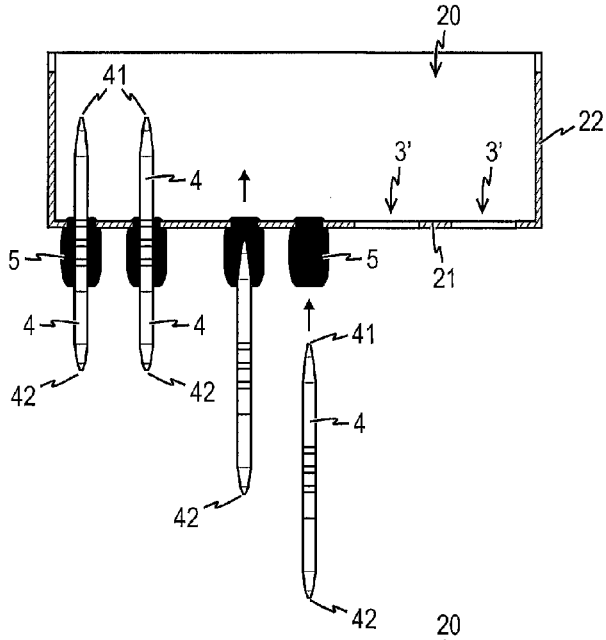
FIG. 10 is a cross-sectional view of the connector housing of FIG. 9 in the sectional plane C-C' when the dielectric inserts are pierced with connector pins.

A further example method will be now explained with reference to FIGS. 9 to 11. After providing a connector housing 2, for example, a connector housing 2 shown in FIGS. 1 and 7 with pin receiving openings 3, 3' in its bottom side 21, a dielectric insert 5 is inserted in at least one of two or more of the pin receiving openings 3, 3'. FIG. 9 shows the connector housing 2 with the pin receiving openings 3 of FIG. 7 provided with inserts 5. The inserts 5 are placed in the pin receiving openings 3, 3' before insertion of the connector pins 4 into the inserts 5.

For example, the inserts 5 may be produced by injection molding. This can allow a tight friction fit of the inserts 5 in the respective pin receiving openings 3. As illustrated in FIG. 10, in one or more subsequent steps, each one of the inserts 5 is pierced with one or more connector pins 4 such that each one of the connector pins 4 extends through the respective pin receiving opening 3. After the insertion of the connector pins 4, the first ends 41 and the second ends 42 are arranged on antipodal sides of the respective insert 5. For example, after insertion, the first ends 41 and the second ends 42 are arranged on opposite sides of the insert 5. Connector pins 6 with first ends 61 and second ends 62 (see FIGS. 6 and 12 as connector pins 6 are not shown in FIG. 10) may be inserted into other inserts 5 in the same manner. During insertion, the material of the inserts 5 is displaced by the connector pins 4, 6 which can cause a tight friction fit of the connector pins 4, 6 in the inserts 5. The inserts 5 may have or may not have clearances before the connector pins 4 are inserted into the inserts 5. For example, the inserts 5 may have clearances with a cross-sectional area substantially smaller than the cross-sectional area of the connector pins 4, or the insert 5 may not have clearances when inserted into the pin receiving openings 3, 3' and instead, the connector pins 4 piercing the insert 5 forms clearances in the insert 5.

Figure 11:
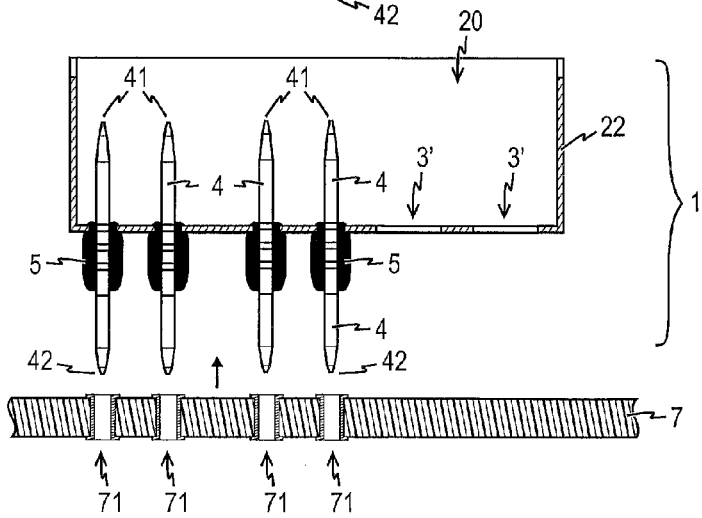
FIG. 11 is a cross-sectional view of the completed connector of FIG. 10 prior to being mounted to a connector board.

As illustrated in FIG. 11, all of the connector pins 4 (and also all of the connector pins 6 although not shown in FIG. 11) have been inserted into the respective insert 5 so as to form an electrical connector 1. As can be seen from FIG. 11, the side wall 22 surrounds the first ends 41, 61 of each of the connector pins 4, 6. The connector 1 may then be soldered to a connector board 7 such as a conventional printed circuit board with conductive lines (not shown). The electrical connection between the connector pins 4, 6 and the connector board 7 may, for example, take place by soldering. In the present example, the connector board 7 has a number of soldering eyelets 71. Each of the soldering eyelets 71 is designed to receive another one of the connector pins 4, 6.

The electrical connector 1 may be connected to a device by one or more connection techniques such as by surface mount soldering, by electrically conductive gluing, by clamping, by screwing, by riveting, and the connection technique described above. Depending on the intended connection technology, the second ends 42, 42 of the connection pins 4, 6 may be designed as a flat, curved ribbon, as a clamp, as a screw terminal, as a soldering eyelet, as a straight end or may exhibit any other suitable design that allows for an electrical connection.

A connector may substantially eliminate stray radiation. For example, the bottom wall of the housing may be electrically conductive, and the bottom wall can serve as a shielding which helps to suppress stray radiation. A connector as described herein may be used as a connector for an electronic assembly such as a slide-in module. Slide-in modules may be used in automotive applications such as car radios, navigation systems, sound systems or other electronic devices that can be pushed into a corresponding slot, thereby being electrically connected by means of an electrical connector which forms a part of the slide-in module. However, an electrical connector as described herein may also be used in applications other than in automotive applications.

Figure 12:
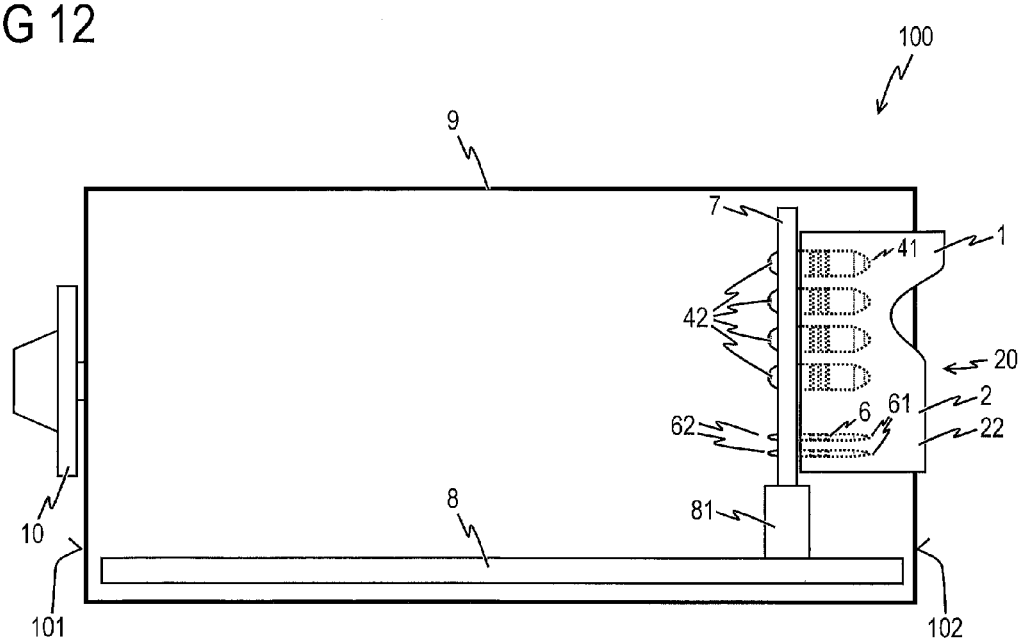
FIG. 12 is a cross-sectional view of an example slide-in module which is equipped with the connector of FIG. 11 mounted to the connector board.

FIG. 12 is a schematic cross-sectional view of an example slide-in module 100 equipped with the connector of FIG. 11 mounted on the connector board 7. The slide-in module 100 is provided with a housing 9, a front side 101, and a rear side 102. A main board 8 which may be a printed circuit board, is equipped with a socket 81 arranged inside the housing 9. The connector board 7 with the electrical connector 1 soldered to it is plugged into the socket 81, thereby creating electrical connections between at least some of the connector pins 4, 6 and the main board 8. In doing so, the electrical connector 1 is arranged at the rear side 101 with the first ends 41, 61 of the connector pins 4, 6 facing away from the front side 101.

Such a slide-in module 100 may be, for instance, a car radio or another electronic device that can be pushed with its rear side 102 and the electrical connector 1 ahead into a corresponding slot of a module rack, for example, a module rack of a car, thereby being electrically connected by means of the electrical connector 1 to a corresponding female counter connector which is arranged at the end of the slot of the module rack.

At the front side 101 of the slide-in module 100, one or more operator's control elements can be arranged. Such control elements may be push-buttons, rotary knobs etc. which serve for various functions such as volume control, station selection, music selection, audio settings, traffic settings, navigation system settings, switching the assembly on or off, etc. One or more displays may be arranged on the front side. Representative for any of the mentioned control or display elements, a rotary knob 10 is illustrated in FIG. 12. However, any other control and/or display element is also appropriate. Except the main board 8, the socket 81, the connector board 7 and the connector 1, all components inside the module housing 9 may be suppressed.

The connectors described herein may not have additional metal shielding other than the conductive connector housing. Nevertheless, an additional metal shielding may be provided.

While various embodiments of the application have been described, it will be apparent to those of ordinary skill in the art that many more embodiments and implementations are possible that are within the scope of this invention. Accordingly, the invention is not to be restricted except in light of the attached claims and their equivalents.

We claim:

1. An electrical connector comprising:
a plurality of connector pins; and
a connector housing having electromagnetic shielding, the connector housing comprising:
a bottom wall comprising a plurality of pin receiving openings, at least some of the pin receiving openings having a dielectric insert; and
a receiving opening configured to receive a counter connector;
where at least one of the plurality of connector pins extends through and is fastened by the dielectric insert within a respective pin receiving opening;
where in an orthogonal plane projection of the bottom wall, a total area of all of the pin receiving openings is less than or equal to 39% of a total area of the bottom wall.

2. The electrical connector as claimed in claim 1, where each of the plurality of connector pins comprises a first end and a second end, the second end located on a different side of the bottom wall than the first end.

3. The electrical connector as claimed in claim 1, where at least one of the dielectric inserts fastens only one of the plurality of connector pins.

4. The electrical connector as claimed in claim 1, where at least one of the dielectric inserts fastens two or more of the plurality of connector pins.

5. The electrical connector as claimed in claim 1, where the plurality of connector pins comprises at least three connector pins, and the receiving openings comprise at least two receiving openings.

6. The electrical connector as claimed in claim 1, further comprising a side wall that surrounds the bottom wall.

7. The electrical connector as claimed in claim 1, where at least some the dielectric inserts are separated from one another by a distance.

8. The electrical connector as claimed in claim 1, where the dielectric insert comprises an injection molded material.

9. The electrical connector as claimed in claim 1, where the connector housing comprises a dielectric body having an electrically conductive coating thereon.

10. A slide-in module comprising:
an electronic assembly comprising a front side with one or more operator control elements, and, opposite to the front side, a rear side; and
an electrical connector comprising:
a plurality of connector pins; and
a connector housing having electromagnetic shielding, the connector housing comprising:
a bottom wall comprising a plurality of pin receiving openings, at least some of the pin receiving openings having a dielectric insert; and
a receiving opening configured to receive a counter connector,
where at least one of the plurality of connector pins extends through and is fastened by the dielectric insert within a respective pin receiving opening,
where in an orthogonal plane projection of the bottom wall, a total area of all of the pin receiving openings is less than or equal to 39% of a total area of the bottom wall,
where the electrical connector is fastened to the electronic assembly at the rear side.

11. The slide-in module of claim 10, where each of the plurality of connector pins comprise a first end and a second end located on a different side of the bottom wall than the first end, and where each first end of the plurality of connector pins run parallel to one another and face away from the electronic assembly.

12. A method for producing an electrical connector comprising:
providing an electrically conductive connector housing with a bottom wall, the bottom wall comprising a plurality of pin receiving openings;
providing a plurality of connector pins;
fastening in each of the plurality of pin receiving openings at least one of the plurality of connector pins with a dielectric insert such that each one of the plurality of connector pins extends through one of the plurality of pin receiving openings, and such that each one of the plurality of pin receiving openings comprises a dielectric insert
inserting each of the dielectric inserts in a respective pin receiving opening of the plurality of pin receiving openings; and
inserting, subsequently, in each of the dielectric inserts at least one of the plurality of connector pins such that each of the plurality of connector pins extends through a pin receiving opening of the plurality of pin receiving openings.

13. The method as claimed in claim 12, further comprising: pre-assembling each one of the dielectric inserts with at least one of the plurality of connector pins; and inserting each one of the pre-assembled dielectric inserts in a pin receiving opening of the plurality of pin receiving openings.

14. The method as claimed in claim 12, where, after inserting each of the dielectric inserts in the plurality of pin receiving openings, each of the plurality of pin receiving openings is completely covered by a dielectric insert.

15. The method as claimed in claim 14, where each of the plurality of connector pins comprises a first end and a second end, each of the dielectric inserts is pierced with at least one of the plurality of connector pins such that each connector pin penetrates a dielectric insert of the dielectric inserts with the first end ahead, the first end and the second end are arranged on opposite sides of the bottom wall, and the first end and the second end are freely accessible.

16. The method as claimed in claim 15, where the electrically conductive connector housing comprises a side wall which, after inserting each of the dielectric inserts in the plurality of pin receiving openings, surrounds the first end of each of the plurality of connector pins.

17. The method as claimed in claim 12, where, in an orthogonal plane projection of the bottom wall, a ratio between a sum of aperture areas of all of the plurality of pin receiving openings formed in the bottom wall and a floor area of the bottom wall of the electrically conductive connector housing is less than or equal to 0.39.

* * * * *